US009366020B2

(12) United States Patent
Farnsworth

(10) Patent No.: US 9,366,020 B2
(45) Date of Patent: Jun. 14, 2016

(54) MODULAR BUILDING UNIT CONNECTION SYSTEM

(71) Applicant: FC+Skanska Modular, LLC, New York, NY (US)

(72) Inventor: David Farnsworth, Brooklyn, NY (US)

(73) Assignee: FC MODULAR, LLC, Brooklyn, NY (US)

( * ) Notice: Subject to any disclaimer, the term of this patent is extended or adjusted under 35 U.S.C. 154(b) by 0 days.

(21) Appl. No.: 14/072,063

(22) Filed: Nov. 5, 2013

(65) Prior Publication Data

US 2014/0123573 A1 May 8, 2014

Related U.S. Application Data

(60) Provisional application No. 61/723,139, filed on Nov. 6, 2012.

(51) Int. Cl.

| | |
|---|---|
| ***E04B 1/34*** | (2006.01) |
| ***E04B 1/348*** | (2006.01) |
| ***E04B 1/22*** | (2006.01) |
| ***E04H 1/04*** | (2006.01) |

(52) U.S. Cl.

CPC ..... *E04B 1/3483* (2013.01); *E04B 1/22* (2013.01); *E04H 1/04* (2013.01)

(58) Field of Classification Search

CPC ..... E04B 1/3483; E04B 2001/3583; E04B 1/348; E04B 1/22; E04B 1/34823; E04B 2001/2418; E04B 2001/2496; E04H 1/04; E04H 1/005; E04H 1/1205; E04H 2001/1283; E04G 21/142; E04C 3/30; Y10T 403/34; Y10T 403/341; Y10T 403/345; Y10T 403/346; Y10T 403/349; B65D 21/0201; B65D 21/0202; B65D 21/0204; B65D 21/02

USPC ..... 52/79.1, 79.2, 79.3, 79.7, 79.9, 79.12, 52/79.13, 125.5, 125.6, 223.13, 223.5, 52/223.8, 240, 848, 79.5, 236.3

See application file for complete search history.

(56) References Cited

U.S. PATENT DOCUMENTS

| | | | | | |
|---|---|---|---|---|---|
| 1,012,423 | A | * | 12/1911 | Orr | 52/184 |
| 1,515,257 | A | * | 11/1924 | Krasnow | E04C 3/30 264/201 |
| 2,086,009 | A | * | 7/1937 | Walker | 52/292 |
| 3,500,595 | A | * | 3/1970 | Bennett | 52/79.13 |
| 3,540,173 | A | * | 11/1970 | Johnides | 52/79.5 |
| 3,594,971 | A | * | 7/1971 | Hughes | 52/648.1 |
| 3,642,310 | A | * | 2/1972 | Hudson | 403/219 |

(Continued)

*Primary Examiner* — Robert Canfield
*Assistant Examiner* — Matthew Gitlin

(57) ABSTRACT

A modular unit connection system for joining together a plurality of box-shaped modular units to form a single or multistory building. The modular building units have elongated hollow structural framing members at their vertical corners and four substantially perpendicular vertical side walls extending between their vertical corner members. The side walls are topped with horizontal framing members extending between the vertical corner members. The vertical corner members lie within the planes formed by the side walls of the modular units, and their vertical corner members and their adjacent side walls abut with no significant space between them. The modular units may be connected at their vertical corner members with generally flat connection plates. Threaded tension rods may extend through the hollow vertical corner members and may be coupled to tension rods running through the hollow vertical corner members of vertically aligned modular units.

2 Claims, 4 Drawing Sheets

(56) References Cited

U.S. PATENT DOCUMENTS 3,643,390 A * 2/1972 Shelley ..... 52/79.2
3,721,052 A * 3/1973 Boel et al. ..... 52/79.13
3,782,061 A * 1/1974 Minutoli et al. ..... 52/125.5
3,818,654 A 6/1974 Schramm
3,822,519 A 7/1974 Antoniou
3,831,332 A 8/1974 Weese
3,832,811 A * 9/1974 Briel, Jr. ..... 52/69
3,940,890 A 3/1976 Postlethwaite
3,965,627 A 6/1976 Fencl
4,254,542 A * 3/1981 Craig ..... E04B 1/2403 29/271
4,299,065 A * 11/1981 Fairgrieve ..... 52/79.7
4,435,927 A 3/1984 Umezu et al.
4,599,829 A * 7/1986 DiMartino, Sr. ..... 52/79.7
4,604,003 A * 8/1986 Francoeur ..... E02D 5/523 29/452
4,644,708 A * 2/1987 Baudot et al. ..... 52/79.9
4,694,621 A * 9/1987 Locke ..... 52/79.13
4,706,428 A * 11/1987 McCoy et al. ..... 52/293.2
4,723,384 A * 2/1988 Mengeringhausen et al. ..... 52/126.1
4,854,094 A * 8/1989 Clark ..... 52/79.1
4,919,122 A * 4/1990 Kohlenbrenner ..... 52/223.7
5,138,808 A * 8/1992 Bengtson et al. ..... 52/204.2
5,182,884 A 2/1993 Tarics
5,678,375 A * 10/1997 Juola ..... 52/655.1
5,735,639 A * 4/1998 Payne et al. ..... 405/129.57
5,782,047 A 7/1998 De Quesada
5,950,373 A * 9/1999 von Hoff et al. ..... 52/79.5
6,463,705 B1 * 10/2002 Davis et al. ..... 52/143
6,568,147 B1 5/2003 Sumner, Sr.
6,625,937 B1 * 9/2003 Parker et al. ..... 52/79.7
6,871,453 B2 3/2005 Locke
7,594,361 B2 9/2009 Tragant Ruano
7,827,738 B2 * 11/2010 Abrams et al. ..... 52/79.1
7,941,984 B2 5/2011 Roig et al.
8,001,730 B2 8/2011 Wallance
8,151,533 B2 4/2012 Krieger
8,297,002 B2 * 10/2012 Fernandez Fernandez .... 52/79.9
8,365,473 B2 * 2/2013 Bjerre ..... 52/79.9
8,499,527 B2 * 8/2013 Kobayashi et al. ..... 52/745.2
8,919,058 B2 * 12/2014 Liberman ..... 52/283
2003/0172612 A1 * 9/2003 Simmons ..... E04B 1/24 52/648.1
2004/0050013 A1 * 3/2004 Okada ..... E04B 1/2403 52/848
2006/0150562 A1 * 7/2006 Simmons ..... E04B 1/2403 52/655.1
2006/0265992 A1 * 11/2006 Hiragaki ..... E04B 1/2403 52/633
2007/0110513 A1 * 5/2007 Fujihashi ..... E04B 1/2403 403/364
2009/0151165 A1 6/2009 Window
2009/0307994 A1 12/2009 Cathcart et al.

* cited by examiner

MODULAR BUILDING UNIT CONNECTION SYSTEM

CROSS-REFERENCED TO RELATED APPLICATIONS

This non-provisional patent application claims the benefit of and priority to Provisional U.S. patent application Ser. No. 61/723,139, entitled MODULAR BUILDING UNIT CONNECTION SYSTEM, which is hereby incorporated herein in its entirety by reference thereto.

FIELD OF THE INVENTION

The present invention relates generally to modular buildings, and more particularly to a system for connecting modular units together to construct multiple unit modular building structures.

BACKGROUND OF THE INVENTION

Modular units have been used to construct residential and industrial structures because they can be assembled at a factory and transported via train, truck or ship to a construction site for assembly into a multi-unit building thereby avoiding much of the delay and expense of field construction. To achieve the maximum benefit from the modular building it is important that modular units be constructed and interconnected in ways which maximize the strength of an assembled modular building, while minimizing the use of external framing and bracing which requires field construction. The interconnection of the box-shaped modules which are the basic building blocks of modular construction has been found to be a critical component in achieving the goals of modular construction.

Various connection systems have been used to enable multi-unit modular buildings to resist external forces, such as those imposed on a building by severe weather. Examples of such systems are disclosed in U.S. Pat. No. 3,831,332 to Weese and U.S. Pat. No. 6,871,453 to Locke. Weese's system links adjacent modular units using a central support column comprised of column segments which extend diagonally from the corner of each modular unit. Tension rods extend through Weese's central columns and are secured at the opposite ends of the columns to hold the column segments and their appended modular units together. Weese's system may be effective with a modular building of a few stories, but the structural strength of Weese's connection system is limited and the geometry of his system results in adjacent modular units being separated by a distance corresponding to the aggregate lateral projections of the column segments which extend from his modular units. The present inventors have determined that avoidable separation of the exterior load bearing walls of adjacent modular units is undesirable in that it tends to make a multi-unit modular structure less rigid and less capable of resisting external forces.

Locke's modular unit connection system utilizes connector bars having opposed upper and lower conical sections with an axial bore to join adjacent modular units. Structural members on Locke's modular units are equipped with conical recesses which are adapted to receive the conical sections at the ends of Locke's connector bars. Tensioner run through the axial bores in Locke's connector bars to hold vertically aligned modular units together. As with Weese's system, Locke's system results in a gap between adjacent modular units. It also suffers the detriment of requiring the fabrication of complex shapes for Locke's connectors and the recesses in the structural member which receive them.

The present invention relates to a novel system for constructing a building with box-shaped modular units. A principal object of the invention is to provide a system which enables the quick and efficient construction of high rise modular buildings having sufficient structural strength to resist the external forces associated with tall buildings and for which the connection work can be performed from the outside of the building's modules, thereby maximizing the amount of finish work that can be completed in the factory.

SUMMARY OF THE INVENTION

The present invention is directed to a modular unit connection system for joining together a plurality of box-shaped modular units to form a single or multistory building. The modular building units of the invention have structural framing members at least their vertical corners which are tubular in nature. As used herein, the term tubular refers to elongated hollow framing members. Such framing members generally have a rectangular cross-section, but may have any hollow cross-section. Framing members with a rectangular cross-section are preferred because they are easily connected to other framing member by welding or with fasteners. However, the instant invention can also be utilized on modular building units having vertical corner framing members with any cross-section which provides a generally vertical conduit from the bottom of the modular unit to the top of the modular unit.

According to the invention, the vertical corner structural members of the modular units lie within the planes formed by the exterior walls of the modular units. With this construction, when two or more modular units are laid side by side with their corners aligned, their vertical corner structural members and their adjacent walls abut with no significant space between them. When four box-shaped modular units are aligned so that they share a single common corner, the four vertical structural members which comprise that common corner align with no material space between them. As used herein, no material space means within normal manufacturing tolerances for the materials of construction. In the case of framing members made of structural steel connected by welding or with fasteners the gap between adjacent vertical structural members will generally be less than one inch, and preferably one half inch or less.

The aforedescribed modular units are connected at their upper corners with a generally flat connection plate which overlays the adjacent corners of the modules being connected and which is fastened to the horizontal framing of the modular units adjacent to the vertical corner columns. The connection plate has apertures, which when the connection plate is mounted on an assembly of modular units, overlies the vertical tubular corner members so as to provide access to the vertical conduits formed thereby. Threaded tension rods extend through the tubular corner members and are coupled to tension rods running through the tubular corner members of vertically aligned modular units forming the successive stories of the modular building. The combination of tension rods and plates provides a connection between columns which holds the modules together, while resisting tension loads in the columns and distributing loads and stress throughout the modular building.

BRIEF DESCRIPTION OF THE DRAWINGS

In the drawings, like reference characters refer to the same parts throughout the different views. Also, the drawings are not necessarily to scale, emphasis instead generally being placed upon illustrating the principles of the invention.

DETAILED DESCRIPTION OF THE PREFERRED EMBODIMENTS

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the invention.

Figure 1:
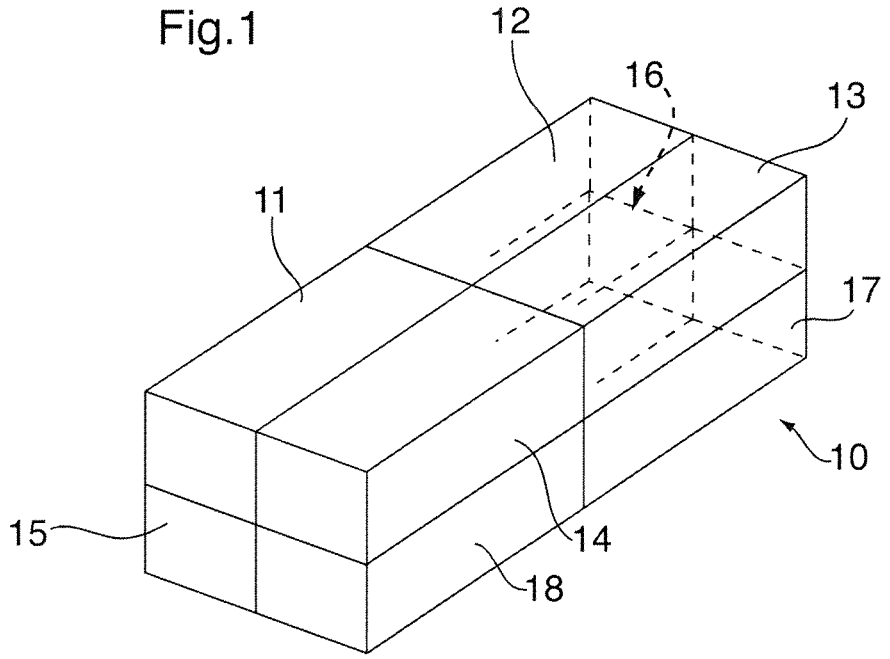
FIG. 1 is a perspective view of an eight module two story modular building section.

Referring to FIG. 1, there is shown a perspective view of two story modular building section 10 comprised of eight modular box-shaped units 11-18. Although the present invention is described with respect to modular building section 10, it applies equally to multi-story high-rise buildings and to structures having any number of modular units on each floor.

Figure 2:
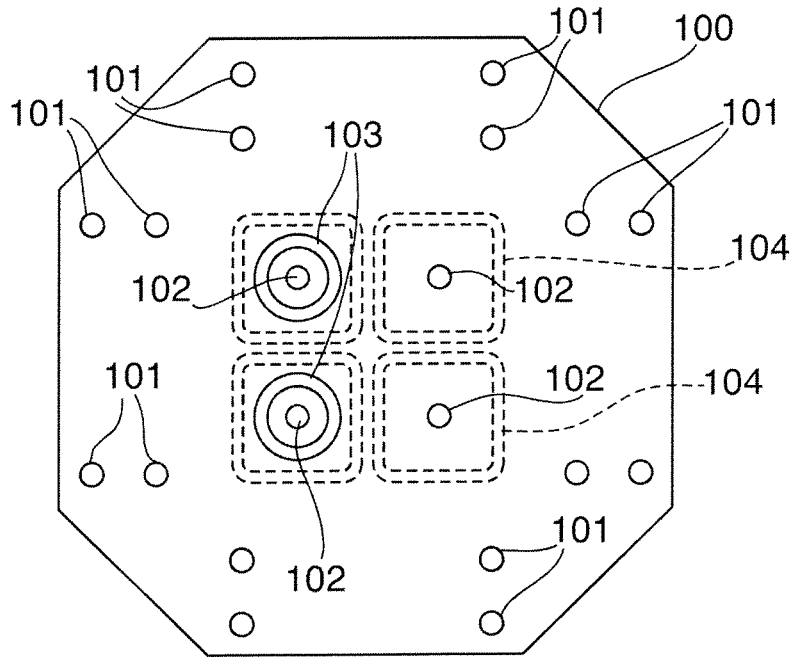
FIG. 2 is an illustrative top view of the connection plate of one embodiment of the invention for connecting four modular units on a floor at a common corner.

Referring to FIG. 2, there is shown a top view of connection plate 100 for joining four adjacent box-shaped modular units at a common corner, such as modules 11, 12, 13 and 14 and modules 15, 16, 17 and 18. Connection plate 100 includes eight pairs of unthreaded bolt holes 101 for affixing connection plate 100 to modular units 11, 12, 13 and 14 and modular units 15, 16, 17 and 18. Connection plate 100 also has four tension rod holes 102. Connection plate 100 has two annular setting pins 103 for ensuring the proper alignment of successive stories of modular units. The typical location of module corner columns 104 when connection plate 100 is installed on modular units 11-14 and modular units 15-18 is shown in dotted lines in FIG. 2.

Figure 3:
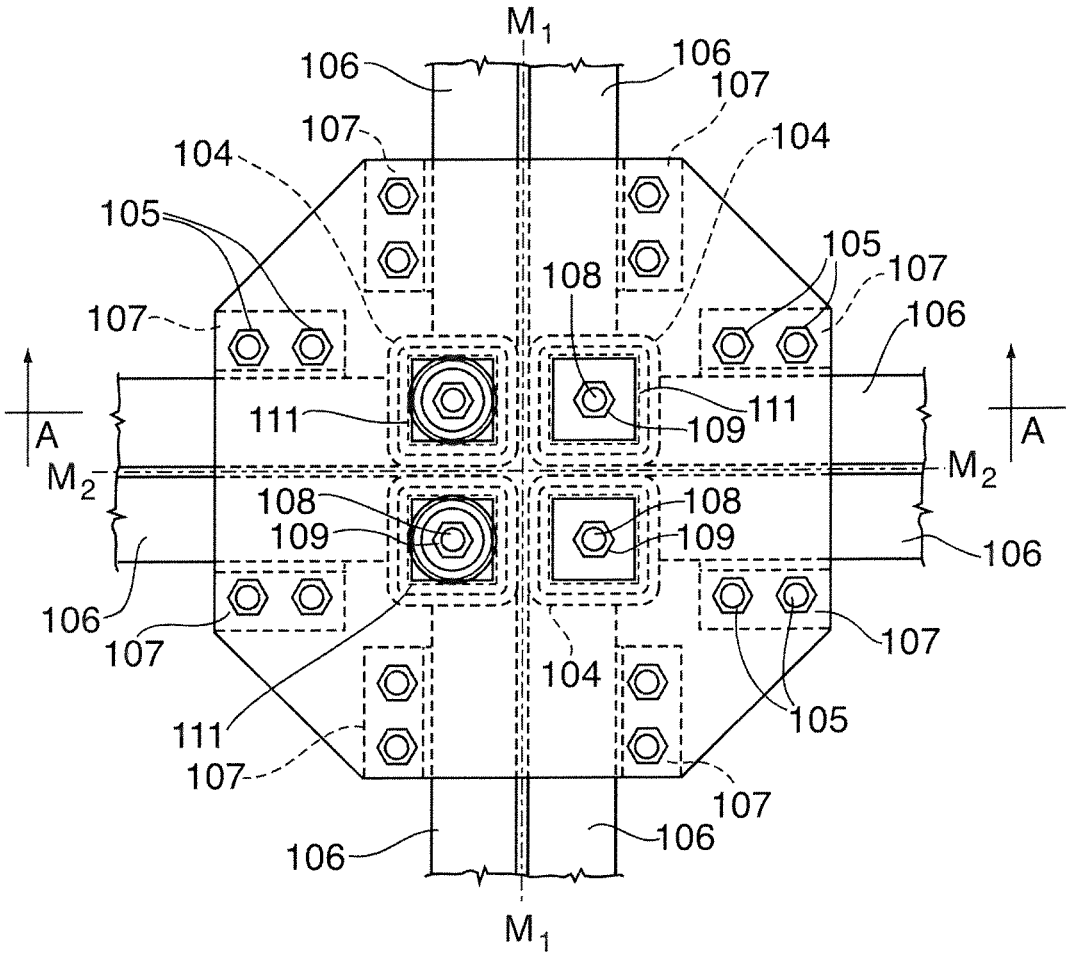
FIG. 3 is an illustrative top view of the modular building unit connection system of the invention connecting four modular units on a floor at a common corner.
Figure 4:
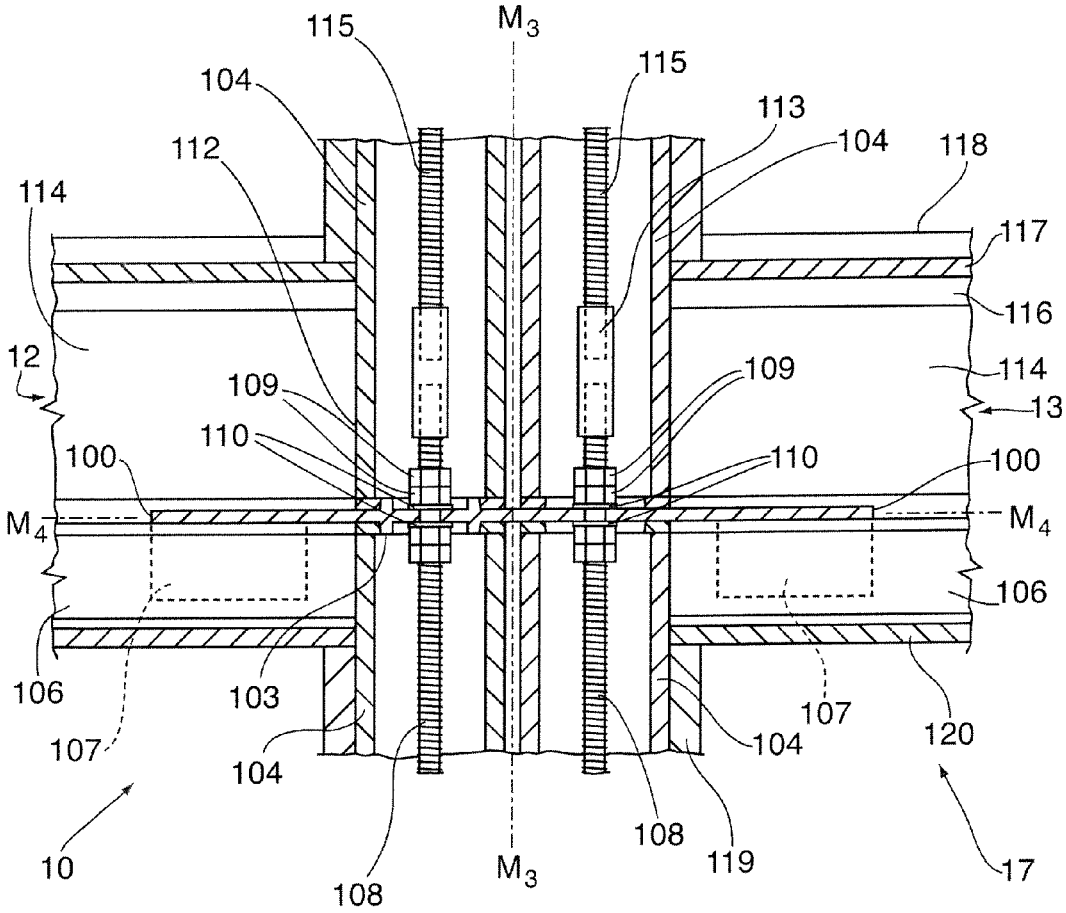
FIG. 4 is an illustrative sectional view taken along line A-A of the connection system of FIG. 3.

Referring to FIG. 3, connection plate 100 is shown installed at the common corner of modular units 15, 16, 17 and 18, which abut at matelines $M_1$ and $M_2$. The upper story of building section 10 comprised of modular units 11, 12, 13 and 14 are mounted on top of modular units 15, 16, 17 and 18, as shown in FIG. 1. Connection plate 100 is mounted to ceiling edge purlins 106 of modules 15-18 and separates the corner columns 104 of upper story modules 11-14 from corner columns 104 of lower story modules 15-18. Connection plate 100 is bolted with bolts 105 through bolt holes 101 to ceiling edge purlins 106 at connector angles 107. Connector angles 107 are preferably welded to ceiling edge purlins 106. Tension tie rods 108 extend through each of corner columns 104 in modules 15-18 and tension tie rods 115, shown in FIG. 4, extend through each of corner columns 104 in modules 11-14. Tension tie rods 108 pass through connection plate 100 at tension rods holes 102 and are fastened to connection plate 100 with rod nuts 109 and washers 110, which are best seen in FIG. 4. To ensure the precise align of upper story modules 11-14 with modules 15-18 in the lower story, modules 11 and 12 with column base caps 111 are set down over annular setting pins 103 and modules 13 and 14 are set down around washers 110 at the positions on connection plate 100 where tension rod holes 102 do not have annular setting pins 103. Column base caps 111 are welded to module corner columns 104 on modules 11-14 and are sized to snuggly fit over the annular setting pins 103 to control the geometric placement of the modules.

FIG. 4 illustrates the abutment of modular units 12, 13, 16 and 17 along matelines $M_3$ and $M_4$ and how tension tie rods 108 and 115 connect successive vertical stories of a modular building according to the invention. Modular units 12 and 13 are placed on top of, respectively, modular units 16 and 17 with corner columns 104 of units 12 and 16 and of units 13 and 17 in overlapping alignment, but separated by connection plate 100. The precise alignment of corner columns 104 of modular units 12 and 13 with corner columns 104 of modular units 16 and 17 is assisted by annular setting pins 103 and column base caps 111 as described above. Floor purlins 114 of modular units 12 and 13 lie on top of ceiling purlins 106 of modular units 16 and 17, separated by connection plate 100. Connection plate 100 is affixed to ceiling edge purlins 106 at connector angles 107. Tension rods 108 extend through corner columns 104 of modular units 16 and 17 and through tension rod holes 102 in connect plate 100. Tension rods 108 are threaded and are affixed to connection plate 100 using washers 110 and tie rod nuts 109. Tension tie rods 108 extend upward beyond connection plate 100 into the interior of corner columns 104 in modular units 12 and 13. Upper story tension tie rods 115 extend through tension rod holes 102 in a connector plate 100 which is affixed to the top of corner columns 104 of modules 11, 12, 13 and 14 and through corner columns 104 in each of modules 11, 12, 13 and 14. As illustrated with respect to modules 16 and 17, upper story tension rods 115 are interconnected with tension tie rods 108 in modules 15, 16, 17 and 18, using sleeve nuts 113. Sleeve nuts 113 are tightened to tension the connection of tension tie rods 108 and 115. Each successive story of a modular building employing the modular unit connection system of this invention preferably has tension tie rods running through its tubular corner columns interconnected with tension tie rods extending through the corner columns of the modular building's lower and upper stories in the same way as described herein with respect to modular units 11-18. Similarly, adjacent modular units are connected at their corner columns with connection plates as described herein with respect to modular units 15-18.

In FIG. 4, flooring 118 in modular units 12 and 13 lies upon cement board 117. Cement boards 117 sits upon floor decking 116. Wall board 119 is applied to the interior surfaces of modules 12, 13, 16 and 17, and ceiling board 120 is affixed to ceiling edge purlin 106.

As illustrated in FIG. 3 and FIG. 4, modular units connected with the connection system of the invention abut with minimal separation. The distance between modular units which are aligned vertically is preferably less than about 1 inch and most preferably by less than ½ inch. Adjacent modular units which are on the same floor of a modular building employing the connection system of the invention also abut with a separation which is preferably less than 1 inch, and most preferably less than ½ inch. When modular building units are connected in accordance with the teachings of the present invention, loads and stress applied to any portion of the modular building are communicated to the structure as a whole, which enables the structure to better resist the same.

It will be evident to those skilled in the art of the invention that the connection system of the invention is readily adapted to situations in which the number of building modules having adjacent corners is less than the aforedescribed four units. When, for example, a building floor plan calls for only two or three modules to have adjacent corners, the shape of connection plate 100 is changed so that it overlays only the modules requiring connection. Even in the case of building modules having corners which are not adjacent to any other modules, as is common for modules positioned at a structure's exterior corners, the modular unit connection system of the invention can be used to connect vertically aligned modules with tension tie rods which run through the modules isolated exterior corner columns.

Figure 5:
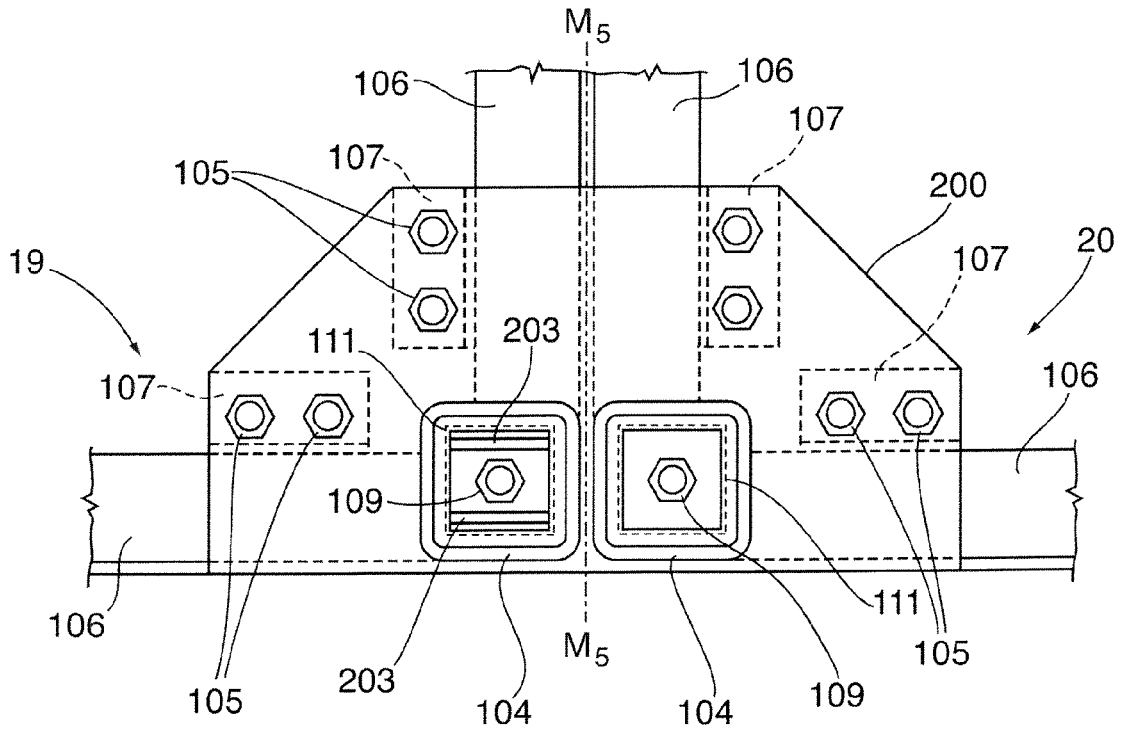
FIG. 5 is an illustrative top view of the modular building unit connection system of the invention connecting two modular units on a floor at a common corner.

Referring to FIG. 5, connection plate 200 is shown installed at the common corner of modular units 19 and 20, which abut at mateline $M_5$ Connection plate 200 is bolted with bolts 105 through bolt holes 101 in connection plate 200 to ceiling edge purlins 106 of modules 19 and 20 at connector angles 107. If an upper story of modules overlie modules 19 and 20, connection plate 200 separates the corner columns 104 of upper story modules from corner columns 104 of lower story modules 19 and 20. Connector angles 107 are preferably welded to ceiling edge purlins 106. Tension tie rods 108 extend through corner columns 104 in modules 19 and 20 and pass through connection plate 200 at tension rods holes 102 and are fastened to connection plate 200 with rod nuts 109 and washers 110. To ensure the precise align of any upper story module with module 19 in the lower story, the upper story module with column base cap 111 can be set down over setting pins 203 on connection plate 200. Any upper story module to be mounted on top of module 20 is set down around washer 110 on tension rod 108 which runs through corner column 104 in module 20. Column base caps 111 are welded to module corner columns 104 and are sized to snuggly fit over the setting pins 203 and around washer 110 to control the geometric placement of the modules.

Although the invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. It is further contemplated that various combinations and sub-combinations of the specific features and aspects of the embodiments may be made and still fall within the scope of the invention. It is intended that the scope of the present invention herein disclosed should not be limited by the particular disclosed embodiments described above, but should be determined only by a fair reading of the claims that follow.

It should be noted that certain objects and advantages of the invention have been described above for the purpose of describing the invention and the advantages achieved over the prior art. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

What is claimed is:

1. A modular building construct comprising prefabricated box-shaped modular building units having vertical hollow interior structural framing members in each of the four vertical corners of said modular units and ceiling edge purlins extending between all four of the vertical corner members in each modular building unit, wherein:

the hollow interiors of said vertical structural framing members form conduits which extend from the bottom to the top of the modular building units, four of said box-shaped modular building units are in two by two orientation in a first building story with a vertical corner member of each modular building unit having exterior surfaces which are juxtaposed with exterior surfaces of vertical corner members on two other modular units of said four modular building unit construct and wherein each of said modular building units has two ceiling edge purlins the lateral sides of which are juxtaposed with the lateral sides of ceiling edge purlins of two other modular building units of the four modular unit construct with no material separation between said juxtaposed vertical corner member exterior surfaces and said lateral sides of the juxtaposed ceiling edge purlins, a second building story of four box-shaped modular building units on top of said first story of modular building units and positioned with respect to the modular building units in said first story whereby the vertical structural framing members in each of the four corners of said first and second story modular building units are in axial alignment, tension rods extend through the conduits in the vertical corner members of said first and second building stories and said tension rods are coupled together to create composite tension rods which runs from the bottom of said first story modular building units to the top of said second story modular building units, wherein the four modular building units of the first story are connected with a generally flat connection plate which extends over four vertical corner members having juxtaposed exterior surfaces, said connection plate is affixed to connector angles mounted on the ceiling edge purlins extending from each of said vertical corner members, said connection plate has apertures which extend through said connection plate in the positions of the conduits through each of said vertical corner members and the tension rods extend through the apertures in the connection plate.

2. The modular building construct of claim 1, wherein said vertical structural members with juxtaposed surfaces are rectangular in cross-section.

* * * * *